United States Patent [19]

Chern

[11] Patent Number: 4,917,518

[45] Date of Patent: Apr. 17, 1990

[54] AUTOMATIC PENCIL

[76] Inventor: Hann-Tzong Chern, No. 84, Song-Po St., Panchiao City, Taipei Hsien, Taiwan

[21] Appl. No.: 289,912

[22] Filed: Dec. 27, 1988

[51] Int. Cl.[4] ..... B43K 21/16

[52] U.S. Cl. ..... 401/65; 401/79

[58] Field of Search ..... 401/99, 101, 116, 66, 401/70, 79, 53, 57, 65, 67, 94, 62

[56] References Cited

U.S. PATENT DOCUMENTS 3,850,531 11/1974 Ackermann ..... 401/65

4,106,874 8/1978 Torii ..... 401/67

FOREIGN PATENT DOCUMENTS 41372 6/1988 Taiwan .

*Primary Examiner*—Richard J. Johnson

*Attorney, Agent, or Firm*—Lerner, David, Littenberg, Krumholz & Mentlik

[57] ABSTRACT

An automatic pencil includes a front housing and a rear housing. A lead-propelling unit and a control unit are positioned within the front and rear housings respectively. The control unit is retained on the propelling unit. When the rear housing is continuously rotated relative to the front housing in a certain direction, a lead rod intermittently moves forward to project from the pencil tip. The propelling unit has a first engagement element, while the control unit has a second engagement element. Each of the first and second engagement elements has several sprocket teeth provided annularly on an end surface thereof. After use, the rear housing may be rotated relative to the front housing in the opposite direction so that the barbed ends of the second engagement element pull the barbed ends to the first engagement element backward. A compression spring helps the first engagement element, and hence the lead rod projecting from the pencil tip, to move backward.

3 Claims, 5 Drawing Sheets

AUTOMATIC PENCIL

BACKGROUND OF THE INVENTION

This invention relates to an automatic pencil having a front housing and a rear housing, the rear housing being rotatable relative to the front housing in opposite directions so as to move the lead rod forward or backward.

Automatic pencils are usually classified into push types and rotary types. I disclosed a rotary type automatic pencil in my Taiwanese Pat. No. 41372, hereinafter referred to as the parent patent, which was granted and published on June 1, 1988. The improvement of this invention is directed to the parent patent and thus has applied for an additional patent of the parent patent on Nov. 30, 1988, under the same Taiwanese Patent Application Ser. No. 76204709 as covered in the application for the parent patent.

DESCRIPTION OF THE PRIOR ART

Referring to FIGS. 1–3, the automatic pencil of the parent application includes a housing unit which consists of a front or lower housing 11 and a rear or upper housing 12. The lower housing 11 includes a guide means 110 which has an upper shoulder 111 and a lower shoulder 112. A propelling unit 2 is fixed within the lower housing 11 and includes an inner tubular member 25, an externally splined rear or upper ring 251 sleeved rigidly on the lower end portion of the inner tubular member 25, a first engagement element 253 secured to the upper end of the inner tubular member 25 and having several sprocket teeth provided on the upper surface thereof, a sleeve 26, a rear or upper coiled compression spring 252, and a chuck unit connected to the lower end of the inner tubular member 25. The chuck unit includes a connecting tube 210 secured to the lower end of the inner tubular member 25, a chuck 21 connected to the lower end of the connecting tube 210, a cylinder 211 sleeved movably on the connecting tube 210, and a front or lower coiled compression spring 213 biasing the cylinder 211 to move downward so that the front or lower ring 212 of the cylinder 211 is sleeved on the chuck 21, thereby holding a lead rod within the chuck 21. The inner tubular member 25 extends coaxially through the sleeve 26. The sleeve 26 has a ribbed outer surface 262 enabling the sleeve 26 to fit into the lower housing 11, and a splined inner surface 261 engaged with the externally splined upper ring 251 so as to prevent the rotation of the inner tubular member 25 relative to the sleeve 26. The upper spring 252 is sleeved on the inner tubular member 25 between the first engagement element 253 and the sleeve 26 for biasing the inner tubular member 25 to move upward. A control unit 3 is installed within the upper housing 12 and includes an outer tubular member 31, a tubular bolt member 32, and a second engagement element 33. The outer tubular member 31 has a ribbed outer surface 301 and an internally threaded upper end 311 which is engaged with the externally threaded lower portion 321 of the bolt member 32 so that the bolt member 32 can move up and down in the upper housing 12 when the upper housing 12, and hence the outer tubular member 31, are rotated relative to the lower housing 11. The bolt member 32 has an enlarged upper portion 322 in which an eraser 323 is inserted. When the eraser 323 is removed from the bolt member 32, lead rods may be placed into the automatic pencil through the open upper end of the bolt member 32. The outer diameter of the second engagement element 33 is slightly smaller than the inner diameter of the outer tubular member 31 so that when assembling the outer tubular member 31, the bolt member 32 and the second engagement element 33, the second engagement element 33 can be pressed upward into the outer tubular member 31 to insert the lower end tongue 324 of the bolt member 32 tightly into the central hole 331 of the second engagement element 33. The second engagement element 33 has several sprocket teeth provided annularly on the lower surface thereof opposite the sprocket teeth of the first engagement element 253. The outer tubular member 31 is provided at its lower end with an inward flange 302 engaged with an annular groove 263 which is formed in the upper end portion of the outer surface of the sleeve 26 so that the outer tubular member 31 can rotate but not move axially relative to the sleeve 26. Because both the outer tubular member 31 and the sleeve 26 are made of plastic, the outer tubular member 31 can be forcibly sleeved on the sleeve 26. The control unit 3 is therefore positioned relative to the propelling unit 2, thereby allowing upper housing 11 to be sleeved on the outer tubular member 31.

The process of assembling the inner tubular member 25, the upper ring 251, the upper spring 252, the first engagement element 253 and the sleeve 26 includes the steps of:

(1) sleeving the upper ring 251 onto the inner tubular member 25;
(2) sleeving the sleeve 26 onto the upper ring 251;
(3) sleeving the upper spring 252 onto the inner tubular member 25; and
(4) securing the first engagement element 253 to the upper end of the inner tubular member 25 in the same manner in which the second engagement element 33 is secured to the outer tubular member 31.

When the upper housing 12 is rotated relative to the lower housing 11 in a certain direction, the outer tubular member 31 rotates synchronously with the upper housing 12 due to the fact that the outer tubular member 31 is in frictional contact with the upper housing 12. The upper spring 252 urges the first engagement element 253 into contact with the second engagement element 33. Referring to FIG. 2, when the sprocket teeth of the first engagement element 253 are well-matched with those of the second engagement element 33, the chuck 21 is enclosed within the lower ring 212, thereby holding a lead rod therein. Referring to FIG. 3, when the upper housing 12 continues to be rotated in the same direction so that the sprocket teeth of the first engagement element 253 are pushed out of the second engagement element 33 due to the fact that the first and second engagement elements 253, 33 interengage by inclined surfaces, the lower ring 212 is blocked from downward movement by the lower shoulder 112 of the guide 110 so that the chuck 21 moves downward away from the lower ring 212, thereby moving the lead rod downward. In this way, the lead rod can be moved downward intermittently by continuously rotating the upper housing 12 relative to the lower housing 11 in the same direction.

When the upper housing 12 is rotated relative to the lower housing 11 in the opposite direction, the bolt member 32 moves upward in the upper housing 12 so that the inner tubular member 25, and hence the lead rod registered within the chuck 21, are biased by the upper spring 252 to move upward. In this way, the lead rod which projects from the guide 110 can return to the lower housing 11.

One problem with the illustrated automatic pencil is that, if the spring force of the upper spring 252 is too large, the inner tubular member 25 and the bolt member 32 may be pushed by the upper spring 252 to move upward when the upper housing 12 is not rotated relative to the lower housing 11. Furthermore, in a case where the spring force of the upper spring 252 is small, when the manufacture of the splined surfaces lacks accuracy or when fine particles, such as dust, exist between the splined surfaces causing increased friction between the splined surfaces, the relative movement between the upper ring 251 and the sleeve 26 becomes slower.

SUMMARY OF THE INVENTION

It is therefore the main object of this invention to provide an automatic pencil in which the lead rod, projecting from the pencil tip, is easily withdrawn.

According to this invention, an automatic pencil is similar to that of the parent patent except that each of the sprocket teeth of the first and second engagement elements has a barbed end. Thereby, after use, the upper housing may be rotated relative to the lower housing in a predetermined direction so that the barbed ends of the sprocket teeth of the second engagement element pull the barbed ends of the sprocket teeth of the first engagement element backward, thereby ensuring the smooth withdrawal of the lead rod.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
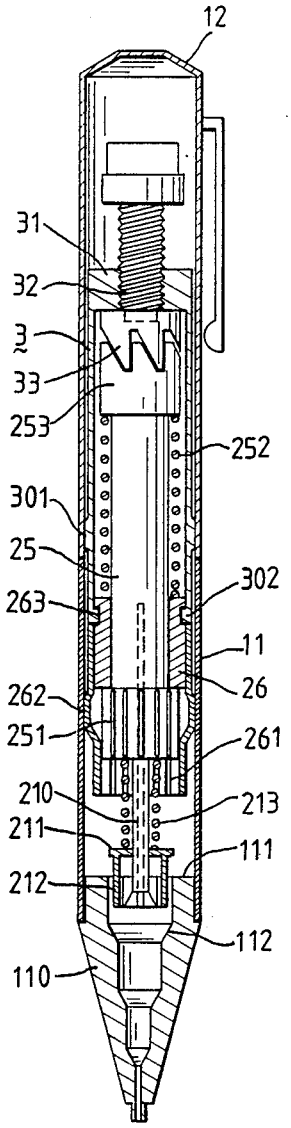
FIG.1 PRIOR ART
FIG. 1 is an exploded view of a conventional automatic pencil.
Figure 3:
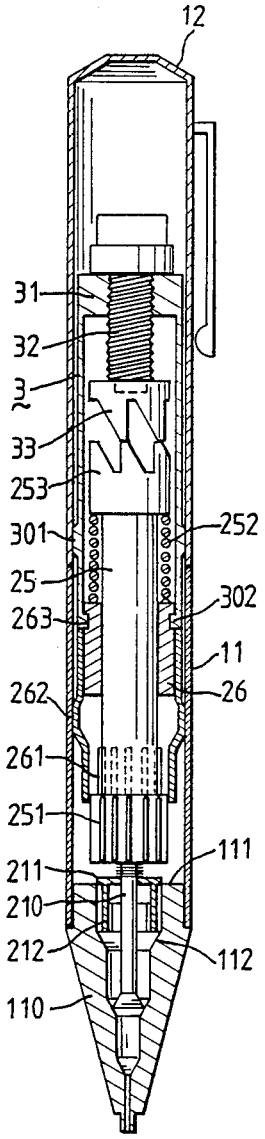
FIG.3 PRIOR ART
FIG. 3 is a sectional view showing the conventional automatic pencil of FIG. 1 in which the first and second engagement elements are not matched with each other.
Figure 2:
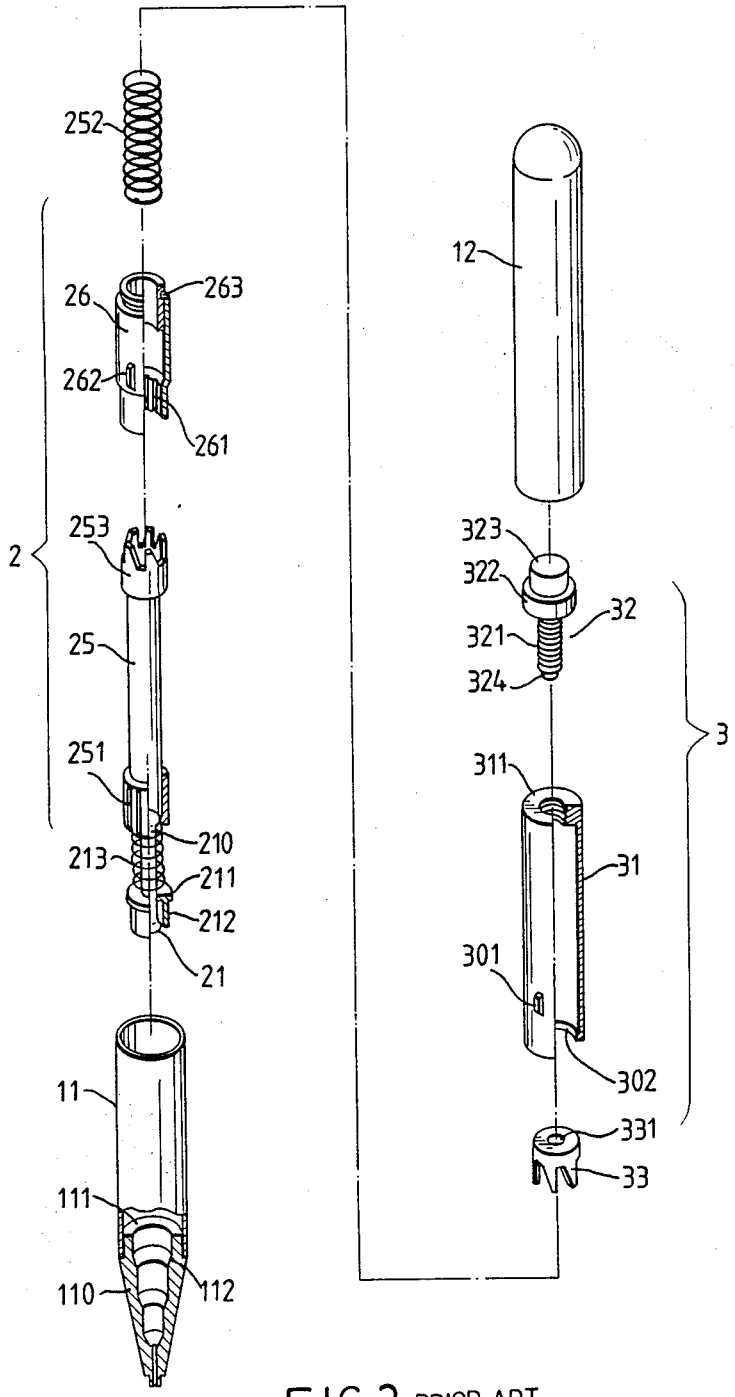
FIG.2 PRIOR ART
FIG. 2 is a sectional view showing the conventional automatic pencil of FIG. 1 in which the first and second engagement elements are well-matched with each other.
Figure 4:
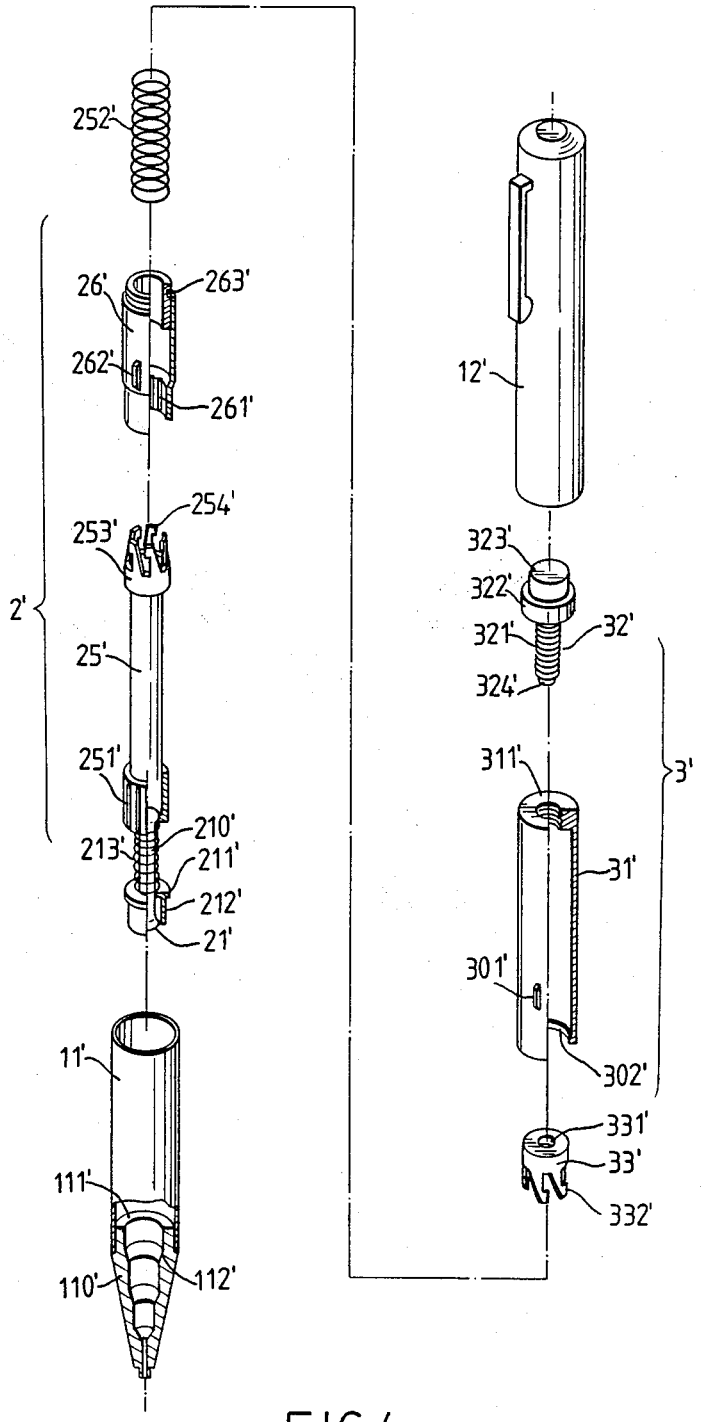
FIG. 4 is an exploded view of an automatic pencil according to this invention.

Referring to FIGS. 4–7, the automatic pencil of this invention includes a housing unit which consists of a front or lower housing 11' and a rear or upper housing 12'. The lower housing 11' includes a guide means 110' which has an upper shoulder 111' and a lower shoulder 112'. A propelling unit 2' is fixed within the lower housing 11' and includes an inner tubular member 25', an externally splined rear or upper ring 251' sleeved rigidly on the lower end portion of the inner tubular member 25', a first engagement element 253' secured to the upper end of the inner tubular member 25' and having several sprocket teeth provided on the upper surface thereof, a sleeve 26', a rear or upper coiled compression spring 252', and a chuck unit connected to the lower end of the inner tubular member 25'. The chuck unit includes a connecting tube 210' secured to the lower end of the inner tubular member 25', a chuck 21' connected to the lower end of the connecting tube 210', a cylinder 211' sleeved movably on the connecting tube 210', and a front or lower coiled compression spring 213' biasing the cylinder 211' to move downward so that the front or lower ring 212' of the cylinder 211' is sleeved on the chuck 21', thereby holding a lead rod 214 within the chuck 21'. The inner tubular member 25' extends coaxially through the sleeve 26'. The sleeve 26' has a ribbed outer surface 262' enabling the sleeve 26' to fit into the lower housing 11', and a splined inner surface 261' engaged with the externally splined upper ring 251' so as to prevent the rotation of the inner tubular member 25' relative to the sleeve 26'. The upper spring 252' is sleeved on the inner tubular member 25' between the first engagement element 253' and the sleeve 26' for biasing the inner tubular member 25' to move upward. A control unit 3' is installed within the upper housing 12' and includes an outer tubular member 31', a tubular bolt member 32', and a second engagement element 33'. The outer tubular member 31' has a ribbed outer surface 301' and an internally threaded upper end 311' which is engaged with the externally threaded lower portion 321' of the bolt member 32' so that the bolt member 32' can move up and down in the upper housing 12' when the upper housing 12', and hence the outer tubular member 31' are rotated relative to the lower housing 11'. The bolt member 32' has an enlarged upper portion 322' in which an eraser 323' is inserted. When the eraser 323' is removed from the bolt member 32', lead rods may be placed into the automatic pencil through the open upper end of the bolt member 32'. The outer diameter of the second engagement element 33' is slightly smaller than the inner diameter of the outer tubular member 31' so that when assembling the outer tubular member 31', the bolt member 32' and the second engagement element 33', the second engagement element 33' can be pressed upward into the outer tubular member 31' to insert the lower end tongue 324' of the bolt member 32' tightly into the central hole 331' of the second engagement element 33'. The second engagement element 33' has several sprocket teeth provided annularly on the lower surface thereof opposite the sprocket teeth of the first engagement element 253'. The outer tubular member 31' is provided at its lower end with an inward flange 302' engaged with an annular groove 263' which is formed in the upper end portion of the outer surface of the sleeve 26' so that the outer tubular member 31' can rotate but not move axially relative to the sleeve 26'. Because the outer tubular member 31' and the sleeve 26' are made of plastic, the outer tubular member 31' can be forcibly sleeved on the sleeve 26'. The control unit 3' is therefore positioned relative to the propelling unit 2', thereby allowing the upper housing 11' to be sleeved on the outer tubular member 31'.

The process of assembling the inner tubular member 25', the upper ring 251', the upper spring 252', the first engagement element 253' and the sleeve 26' includes the steps of:

(1) sleeving the upper ring 251' onto the inner tubular member 25';
(2) sleeving the sleeve 26' onto the upper ring 251';
(3) sleeving the upper spring 252' onto the inner tubular member 25'; and
(4) securing the first engagement element 253' to the upper end of the inner tubular member 25' in the same manner in which the second engagement element 33' is secured to the outer tubular member 31'.

Figure 5:
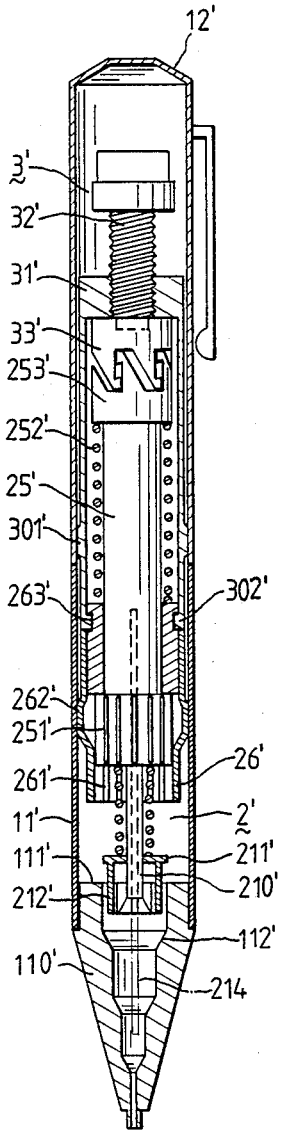
FIG. 5 is a sectional view showing the automatic pencil of this invention in a normal position.
Figure 6:
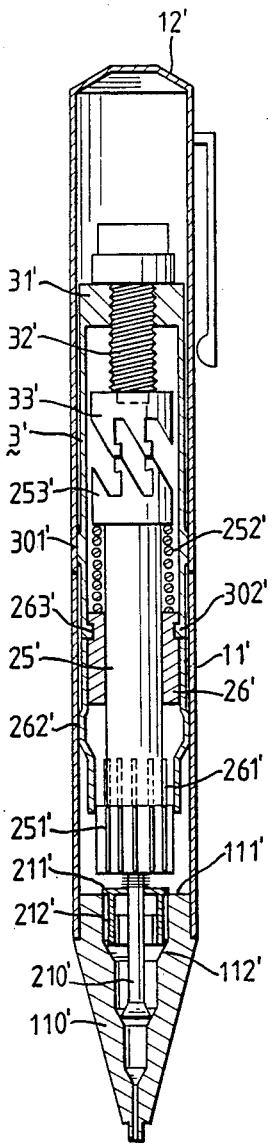
FIG. 6 is a schematic sectional view illustrating how to make a lead rod project from the automatic pencil in accordance with this invention.

When the upper housing 12' is rotated relative to the lower housing 11' in a certain direction,the outer tubular member 31' rotates synchronously with the upper housing 12' due to the fact that the outer tubular member 31' is in frictional contact with the upper housing 12'. The upper spring 252' urges the first engagement element 253' into contact with the second engagement element 33'. Referring to FIG. 5, when the sprocket teeth of the first engagement element 253' are well-matched with those of the second engagement element 33', the chuck 21' is enclosed within the lower ring 212', thereby holding a lead rod therein. Referring to FIG. 6, when the upper housing 12' continues to be rotated in the same direction so that the sprocket teeth of the first engagement element 253' are pushed out of the second engagement element 33' due to the fact that the first and second engagement elements 253', 33' interengage by inclined surfaces, the lower ring 212' is blocked from downward movement by the lower shoulder 112' of the guide 110' so that the chuck 21' moves downward away from the lower ring 212', thereby moving the lead rod downward. In this way, the lead rod can be moved downward intermittently by continuously rotating the upper housing 12' relative to the lower housing 11' in the same direction.

Figure 7:
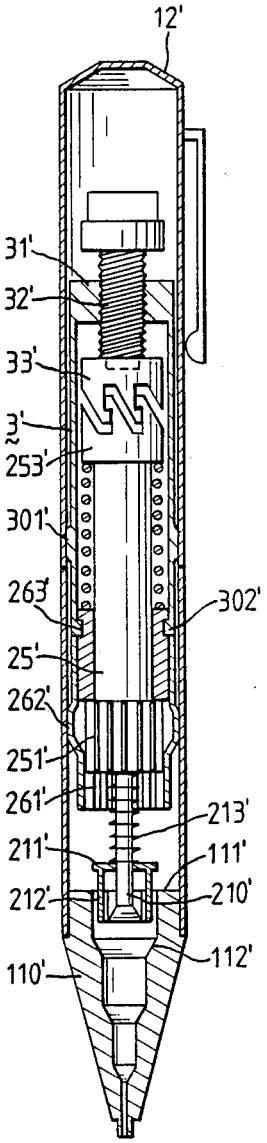
FIG. 7 is a schematic sectional view illustrating how to withdraw a lead rod from a projecting position into the automatic pencil in accordance with this invention.

When the upper housing 12' is rotated relative to the lower housing 11' in the opposite direction, the bolt member 32' moves upward in the upper housing 12' so that the inner tubular member 25', and hence the lead rod registered within the chuck 21', are biased by the upper spring 252' to move upward. Referring to FIG. 7, it can be understood that when the bolt member 32' moves upward, the barbed ends 332' of the second engagement element 33' pull the barbed ends 254' of the first engagement element 253' upward. Accordingly, the lead rod which projects from the guide 110' can fully return to the lower housing 11'. The barbed ends 254', 332' of the engagement elements 253', 33' enable the object of this invention to be achieved.

With this invention thus explained, it is apparent that numerous modifications and variations can be made without departing from the scope and spirit of this invention. It is therefore intended that this invention be limited only as indicated in the appended claims.

I claim:

1. An automatic pencil including:

a housing unit consisting of a lower housing and an upper housing;

a sleeve disposed coaxially in said lower housing and having a ribbed outer surface and a splined inner surface, said ribbed outer surface enabling said sleeve to fit into said lower housing;

an inner tubular member extending coaxially through said sleeve;

an externally splined upper ring sleeved rigidly on an intermediate portion of said inner tubular member so as to engage with said splined inner surface of said sleeve, thereby preventing rotation of said inner tubular member relative to said sleeve;

a tubular first engagement element of a diameter greater than that of said inner tubular member, secured coaxially to an upper end of said inner tubular member, extending out of said lower housing, including several sprocket teeth provided annularly on an upper end surface of said first engagement element;

an upper compression spring sleeved on said inner tubular member between said first engagement element and said sleeve for biasing said first engagement element to move upward away from said sleeve;

a connecting tube having a diameter smaller than that of said inner tubular member and secured coaxially to a lower end of said inner tubular member;

a chuck connect coaxially to a lower end of said connecting tube;

a lower ring sleeved moveably on said connecting tube;

a lower compression spring sleeved on said connecting tube between said lower ring and said upper ring for biasing said lower ring to sleeve on said chuck so as to hold a lead rod within said chuck;

an outer tubular member disposed coaxially in said upper housing and having a ribbed outer surface enabling said outer tubular member to fit into said upper housing, and an internally threaded upper end portion;

means for coupling said sleeve with said outer tubular member in such a manner that said outer tubular member can rotate but not move axially relative to said sleeve;

a tubular bolt member having an enlarged upper end for receiving lead rods, and an externally threaded lower portion engaged with said internally threaded upper end portion of said outer tubular member thereby enabling said bolt member to move axially in said upper housing;

a second engagement element secured to a lower end of said bolt member and including several sprocket teeth provided annularly on a lower end surface thereof so as to engage with said sprocket teeth of said first engagement element;

a cap sealing said enlarged upper end of said bolt member;

characterized in that each of said sprocket teeth of said first and second engagement elements has a barbed free end;

whereby, when said upper housing and hence said outer tubular member are rotated relative to said lower housing in a certain direction, said lead rod registered within said chuck moves downward; and when said upper housing and hence said outer tubular member are rotated relative to said lower housing in the opposite direction, said upper spring urges said first engagement element upward and said barbed ends of said sprocket teeth of said second engagement element pull said barbed ends of said sprocket teeth of said first engagement element upward so as to move said lead rod upward.

2. An automatic pencil as claimed in claim 1, wherein said coupling means includes an inward flange formed on a lower end of said outer tubular member, and an annular groove formed in an upper end of an outer surface of said sleeve and engaged with said inward flange of said outer tubular member.

3. An automatic pencil as claimed in claim 1, wherein said cap is an eraser.

* * * * *